US006331810B1

(12) United States Patent
Jung

(10) Patent No.: US 6,331,810 B1
(45) Date of Patent: Dec. 18, 2001

(54) MAGNETIC LIFTING APPARATUS

(76) Inventor: Hyung Jung, Byucksan Apt. 122-904, Gaya 2-dong, Pusanjin-ku, Pusan (KR), 614-808

( * ) Notice: Subject to any disclaimer, the term of this patent is extended or adjusted under 35 U.S.C. 154(b) by 0 days.

(21) Appl. No.: 09/653,895

(22) Filed: Sep. 1, 2000

(51) Int. Cl.[7] ..... B66C 1/04; H01F 7/04

(52) U.S. Cl. ..... 335/288; 335/295; 269/8; 294/65.5

(58) Field of Search ..... 335/285–306; 269/8; 294/65.5

(56) References Cited

U.S. PATENT DOCUMENTS 5,266,914 * 11/1993 Dickson et al. ..... 335/288
5,382,935 * 1/1995 Doyelle ..... 335/288
5,435,613 * 7/1995 Jung ..... 294/65.5

* cited by examiner

*Primary Examiner*—Ramon M. Barrera
(74) *Attorney, Agent, or Firm*—Reed Smith Hazel & Thomas LLP

(57) ABSTRACT

A magnetic lifting apparatus by using neodymium magnets, incorporating a plurality of polarity plates (10) disposed with a predetermined interval and having non-magnetic medium (11) in the longitudinal center; a plurality of interval members (20) disposed between the polarity plates (10); a top cover (30) covering the interval members (20) and the polarity plates (10), having a hook (31) on the upper side; a plurality of neodymium magnets (40) having S/N polarity in opposite and disposed between the polarity plates (10); a plurality of rotors (50) rotated with the neodymium magnets (40) being inserted therein; a switch handle (60) for switching polarity position of the rotor (50) and the neodymium magnets (40) engaged therewith to switchably generate magnetic attraction. The oxidation prevention means (70) includes a hollow space around the neodymium magnets (40) either vacuum or filled with an oxidation prevention liquid in order to prevent the neodymium magnets (40) from being in contact with oxygen. The present invention prevents the neodymium magnets from being oxidized so as to improve magnetic performance and endurance. Further, the improved magnetic lifting apparatus of the invention minimizes body size and weight, guarantees simple operation, and improves performance and productivity.

12 Claims, 8 Drawing Sheets

MAGNETIC LIFTING APPARATUS

BACKGROUND OF THE INVENTION

1. Field of the Invention

The present invention relates to a magnetic lifting apparatus and more particularly to an improved magnetic lifting apparatus by using neodymium magnet, which prevents the neodymium magnet from being oxidized to improve magnetic performance and endurance with switchable function of an on/off handle.

2. Description of the Related Art

The magnetic lifting apparatus is used in the art for lifting, conveying and releasing the ferromagnetic objects by magnetizing on or off switching.

Generally, the magnetic lifting apparatus comprises poleplates, interval members' therebetween, side walls and a top cover on which a hook is disposed. The plate-shaped poleplates are provided with a permanent magnet arrangement sandwiched in between. Each pair of poleplates is separated by a non-magnetic medium. A rotor is disposed to switch magnetic polarity by using the switching handle.

In the center of the rotor, there is an axial aperture through which the axle is rotatably inserted to the rotor and the polarity plates. One end of the axle is connected to the switching handle for rotation of the axle.

Depending on on/off position of the switch handle, the objects are lifted or released. In the lifted state of the objects, there is provided a locking member for preventing the rotor from unintentionally moving to the off direction.

In rotating the switch handle, the polarity of the line of magnetic force is changed as the directional position of permanent magnetic is switched. The magnetic force becomes OFF in case that the line of magnetic force is applied to the opposite poleplates divided by the non-magnetic medium. If the rotor is switched again, the direction of the line of magnetic force is applied to the poleplates, thereby adsorbing the objects under the poleplates with a strong magnetic attraction to lift and move to the desired place.

For a permanent magnetic of the magnetic lifting apparatus, the ferrite magnetic is widely used, having the remaining magnetic density under 2,000 gauss.

In order to improve, however, a relatively large size of the ferrite magnetic is required to improve magnetic attractive performance.

The large size of the ferrite magnetic necessitates a relatively large size of the magnetic lifting body in a magnetic lifting apparatus, which is disadvantageous to use and in view of the high manufacturing costs as well.

Use of the neodymium magnet in the range of the remaining magnetic density of 10,000–13,000 gauss may improve function of the magnetic body. However, the neodymium magnet has a fatal disadvantage of easy oxidation when the neodymium magnet is exposed in atmosphere, thereby lowering magnetization.

In order to prevent the above disadvantage, coating on the surface of the neodymium magnet with resin or metal may be suggested. However, use of the coated neodymium magnet in the rotor results in exfoliation of the coated film because it is inevitable to rotate in contact with the poleplates.

SUMMARY OF THE INVENTION

Accordingly, it is an object of the present invention to provide an improved magnetic lifting apparatus by using the neodymium permanent magnetic with high coercive force on the rotor in which an oxidation prevention means is formed in the vicinity of the neodymium magnet.

The other object of the present invention is to provide a magnetic lifting apparatus in which direction of the rotor is readily switched on and off with a minimum of force, thereby improving productivity and reliability.

In order to achieve the objects of the present invention, there is provided a magnetic lifting apparatus comprising: plate-shaped polarity plates 10 disposed with a predetermined interval, having non-magnetic medium thereon; an interval member 20 for keeping the interval between the polarity plates 10; top cover 30 covering the interval member 20 and the polarity plates 10, having a hook 31 on the upper side; neodymium magnet 40 having S/N polarity in opposite and disposed between the polarity plates 10; a rotor 50 rotated with the neodymium magnet 40 being inserted therein; a switch handle 60 for switching the polarity position of the rotor 50 and the neodymium magnet 40 engaged therewith to make magnetic attraction on and off; and an oxidation prevention means 70 for blocking the neodymium magnet 40 from oxygen. The magnetic lifting apparatus of the invention has a characteristic to prevent the neodymium magnet from oxidation, to have superior endurance and performance.

In the present invention, the switch handle is readily manipulated to switch on and off magnetic attraction performance, thereby improving productivity and reliability.

The scope of applicability of the present invention will become apparent from the detailed description given hereinafter. However, it should be understood that the detailed description and specific examples, while indicating preferred embodiments of the invention, the given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
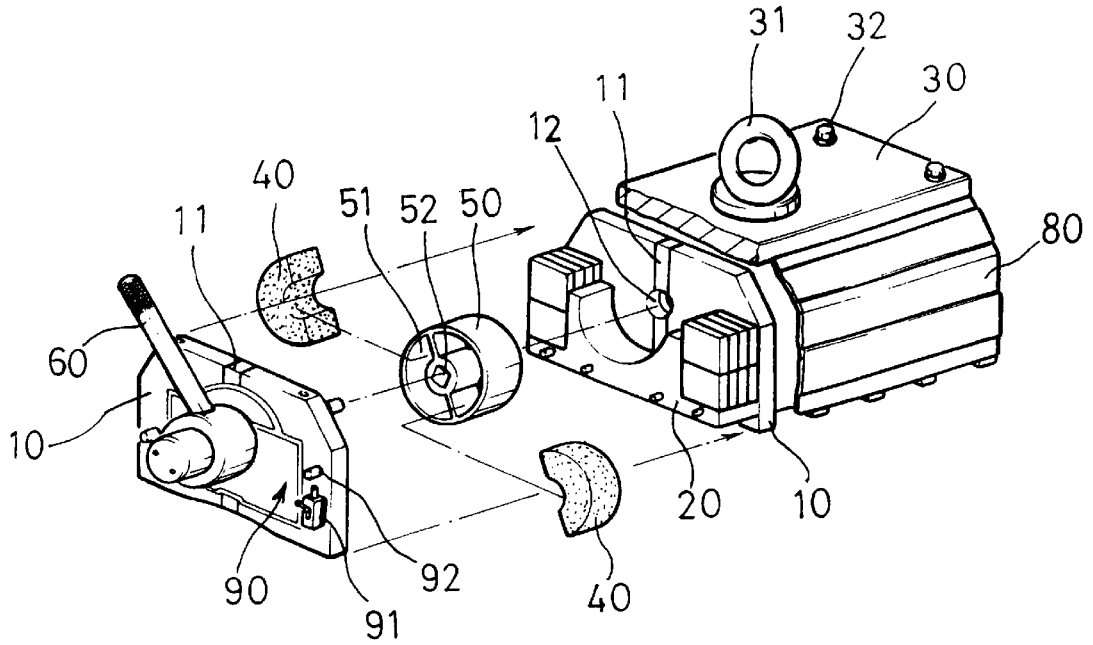
FIG. 1 is a exploded perspective view of the preferred embodiment of the magnetic lifting apparatus according to the present invention.

As shown in FIG. 1, the polarity plate 10 of the present invention performs in such a way to change the magnetic-line of force by switching the N/S polarity position, thereby holding or releasing the ferromagnetic objects to lift and move to the desired position.

The plate-shaped polarity plate 10 is attached to the non-magnetic medium 11 to divide polarity in opposite by welding and spaced with a predetermined interval. The numbers of polarity plates are related to the holding capacity.

Between the polarity plates 10, the interval members 20 are disposed to maintain the space between the polarity plates 10 and block the lower part.

On the polarity plates 10 and the interval members 20, a top cover 30 is disposed to seal the interior.

The top cover 30 is tightly fixed by a plurality of bolts 32 and lifted and moved by a hook of the crane or hoist.

Between the polarity plates 10 a couple of neodymium magnets 40 is disposed with S/N polarity in opposite and the rotor 50 holds the neodymium magnets 40 with two divided for rotation in engagement.

If it is desirable to manipulate the switch handle 60 to rotate the rotor 50 and neodymium magnet 40 engaged thereto for a predetermined angle, the polarity of the neodymium magnets 40 is switched to magnetize the polarity plates 10 oppositely divided by the non-magnetic plate 11 on and off, thereby holding the objects in ON state to lift and move to a desired position by using the apparatus such as a crane or a host.

In order to prevent contact from oxygen in atmosphere, the present invention provides with an oxidation prevention means 70 in the vicinity of the neodymium magnet 40. The magnetic lifting apparatus of the invention utilizes the neodymium magnet 40 with high flux density over 10,000 gauss. Despite superior performance of the neodymium magnet 40, it may easily be oxidized by oxygen to result in corrosion and low endurance. The oxidation prevention means 70 functions to prevent oxidation by oxygen in contact with the neodymium magnet 40.

In providing with the oxidation prevention means 70, several methods are proposed: one is to vacuum the vicinity of the rotor 50 and the neodymium magnet 40; another method is to dispose the colloidal liquid such as grease to block oxygen; and the third method is to film the vicinity of the neodymium magnet 40 by coating metal or synthetic resin. It is most preferable to use the colloidal liquid such as grease in view of lubrication and manufacturing costs in operating the neodymium magnet 40 and the rotor 50.

The colloidal liquid forms an oil film in the vicinity of the neodymium magnet 40 of high density current magnetic having coercive force over 10,000 gauss, thereby blocking exterior air which prevents the neodymium magnet 40 from being oxidized and forms magnetic path even though the interval between two polarity plates 10 is very close, to keep strong holding power.

Accordingly, the improved magnetic lifting apparatus of the invention minimizes a body size and its weight.

Figure 4:
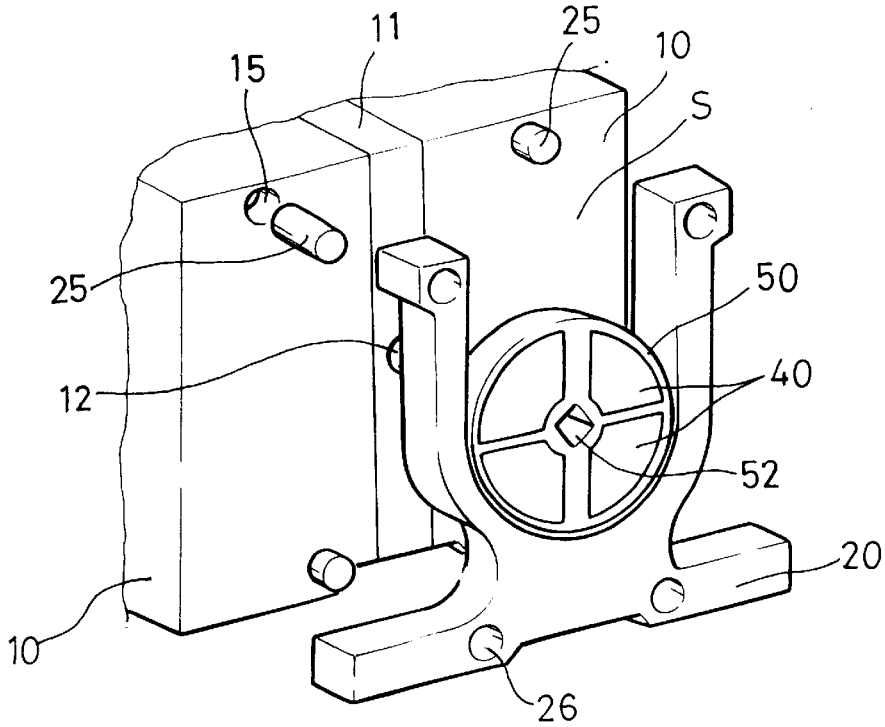
FIG. 4 is an exploded perspective view showing the construction of the interval member 20 for and the rotor 50 according to the present invention
Figure 5:
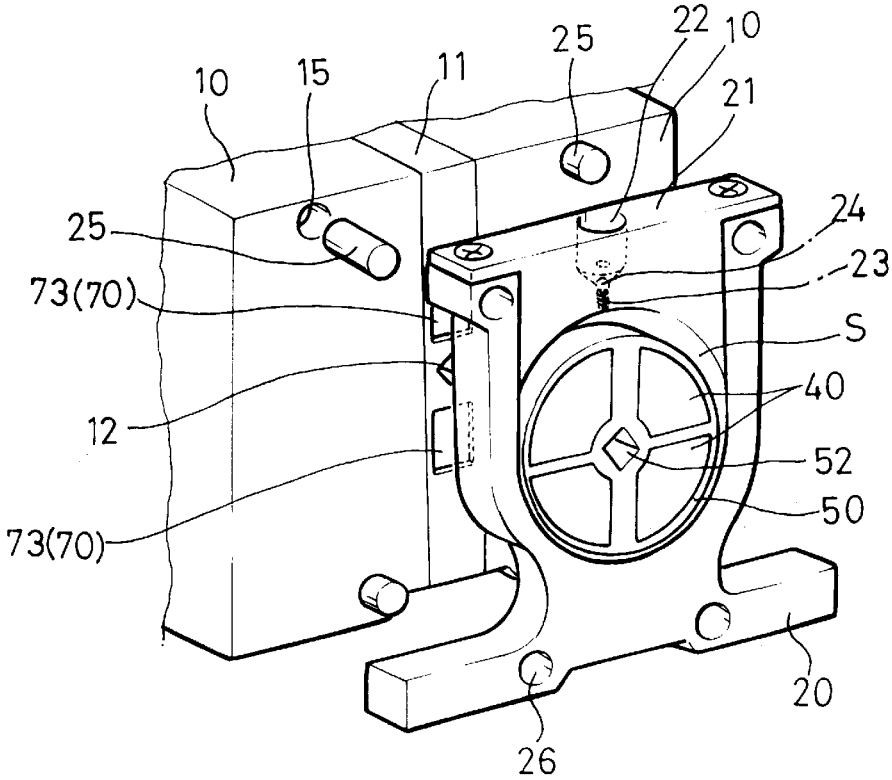
FIG. 5 is an exploded perspective view of another embodiment of FIG. 4, showing a cap 21 disposed on the interval member 20 and liquid oxidation prevention material as the oxidation prevention means 70 supplied to the cap 21.

Referring to FIGS. 4 and 5, the interval members 20 are formed with open upper part to hold a circular-plate-type rotor 50. This shape has an advantage in filling with the oxidation prevention material such as the colloidal liquid in the vicinity of the rotor 50.

The cap 21 on the open upper part of the interval members 20 is covered by using bolts to surround the rotor 50 and forms a pouring hole 22 at the cap 21 (FIG. 5). At the pouring hole 22 a ball 24 elastically supported by a spring 23 is disposed to close up an opening. The colloidal liquid as oxidation prevention material is poured with higher pressure than the elastic spring 23, to be filled around the rotor 50 and the neodymium magnet 40. This fill-up is preferable to do often on demand.

The interval members 20 and the polarity plates 10 are coupled by a plurality pins 25 inserted in pin holes 15 and 26.

Figure 11:
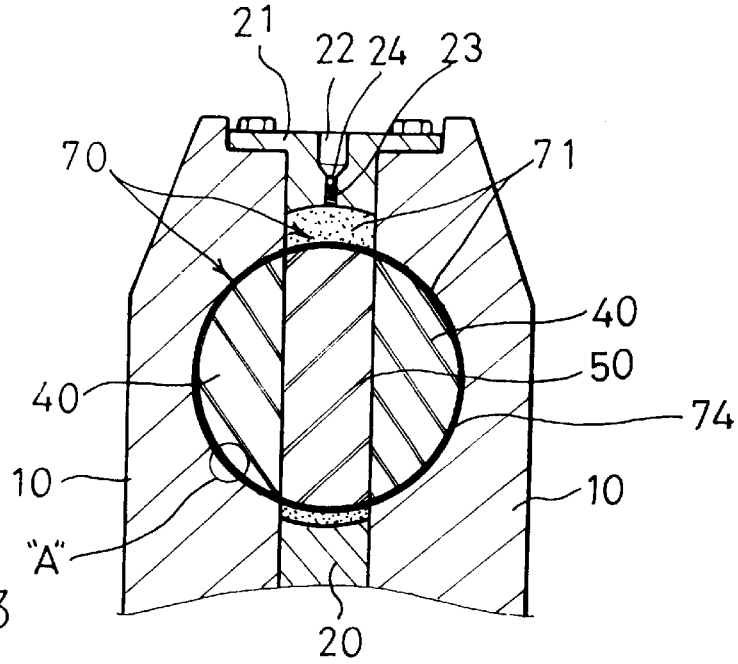
FIG. 11 shows another embodiment of the rotor 50 and the neodymium magnet 40 in which neodymium magnet 40 with two divided forms a rotor 50 in a rod and a liquid reception clearance 74 is disposed on the polarity plates 10.
Figure 13:
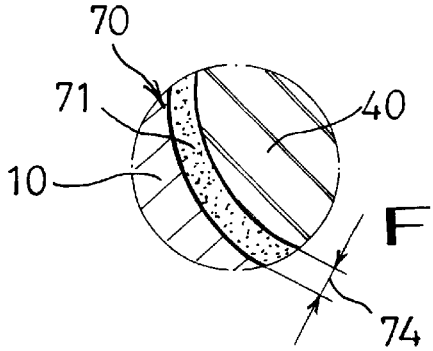
FIG. 13 is an enlarged view of "A" portion of FIG. 11, showing the liquid reception clearance 74 between the neodymium magnet 40 and the polarity plate 10.
Figure 12:
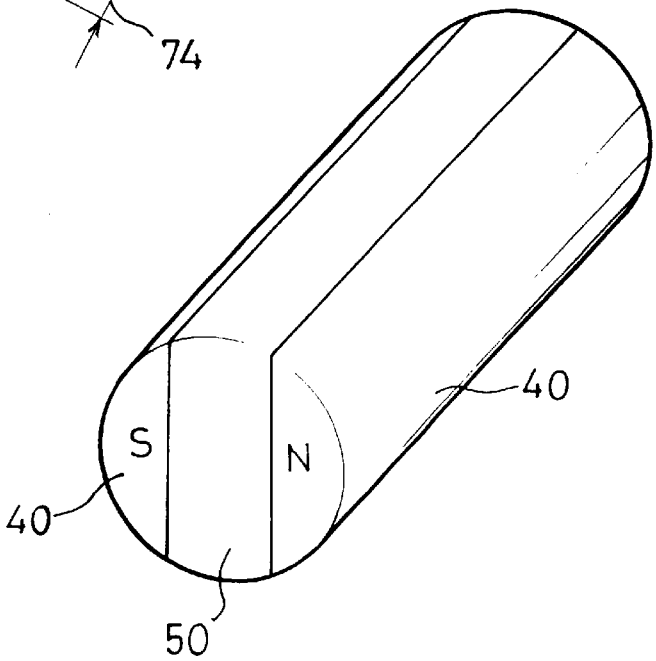
FIG. 12 is a perspective view of the rotor 50 of FIG. 11.
Figure 14:
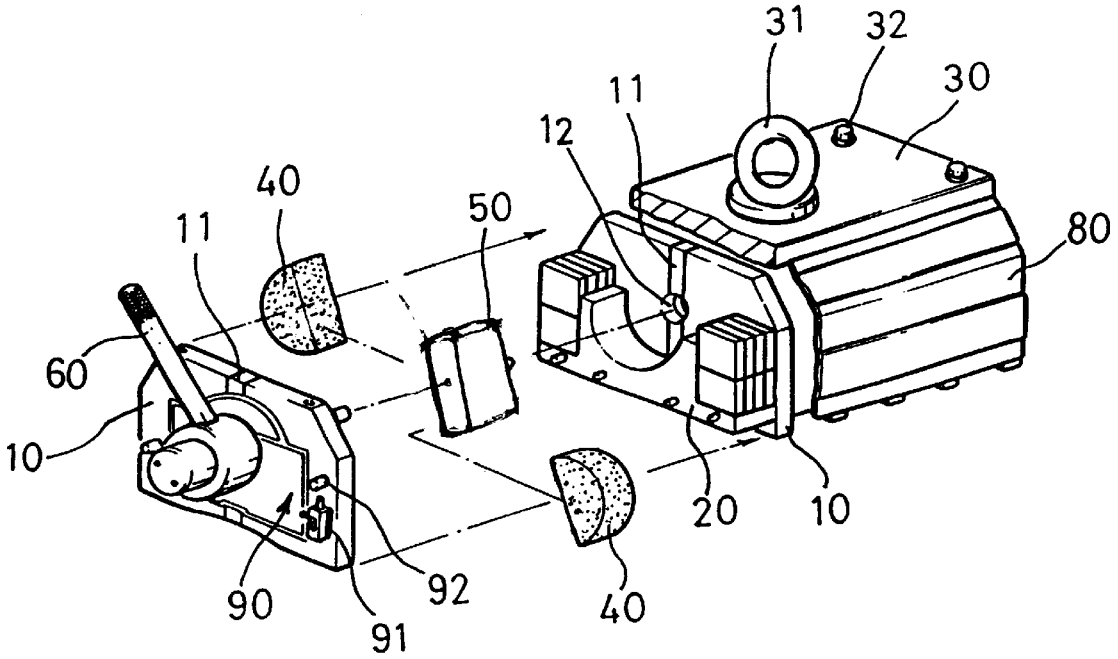
FIG. 14 is a exploded perspective view of another embodiment of the magnetic lifting apparatus including the rod-shaped rotor of FIG. 12 according to the present invention.

The rotor 50 holding the neodymium magnet 40 is position-switched by manipulation of the switch handle 60 to switch the polarity position. The holding type of the rotor 50 may be a circular-plate type neodymium magnet 40 held therein (FIGS. 1 to 10) or a rod type having the neodymium magnet 40 (FIGS. 11 and 12).

In order to dispose a couple or two couples of the neodymium magnets 40 in opposite, it is preferable to form a magnetic reception aperture 51. A tetragonal or long oval axial aperture 52 is formed in the center of rotor 50 to receive a shaft 61 for rotation.

The shaft 61 is protruded to penetrate the axial aperture 52 of the rotor 50 and the axial aperture 13 of the polarity plate 10 for engagement. A switch handle 60 is formed at one end of the shaft 61, which switches holding power on and off in accordance with the position of the switch handles 60.

A handle locking member 90 functions to prevent the switch handle 60 from being slidably moved to the undesirable direction.

Locking operation of the handle-locking member 90 is made with use of a latch 91 and a protrusion 92. In case of ON position of the switch handle 60, the latch 91 is protruded to lock the handle 60 between the protrusion 92, thereby avoiding the switch handle 60 unintentionally moving to OFF position.

The polarity plates 10 and the interval members 20 are covered with side plates 80 to have productivity on sidewalls. Between the top cover 30 and the polarity plates 10 a non-magnetic packing 35 is inserted.

The preferred embodiments of the oxidation prevention means 70 and the rotor 50 are explained in detail hereinbelow.

Figure 2:
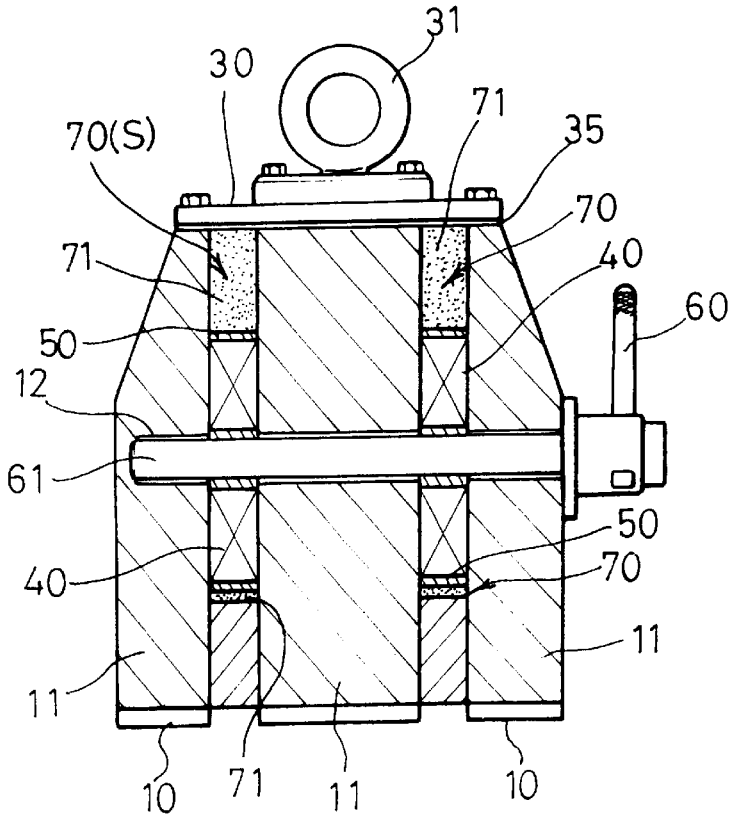
FIG. 2 is a sectional view showing a shaft 61, rotor 50 and neodymium magnet 40 rotated by the switch handle 60, with a plurality with rotors 50 between the polarity plates 10.

Referring to FIG. 2, two interval members 20 are inserted between three polarity plates 10 and a hollow space S between the interval members 20 and the polarity plates 10 is filled with the colloidal liquid 71 for a oxidation prevention means 70.

One end of the shaft 61 is penetrated through the axial aperture 52 in the center of the rotor 50 and the axial aperture 13 of the polarity plate 10 to support in the center of the polarity plate 10, and the other end of the shaft 61 is outwardly protruded to connect to the switch handle 60. Depending on the position of the switch handle 60, the magnetic lifting device is magnetized on and off.

Figure 3A:
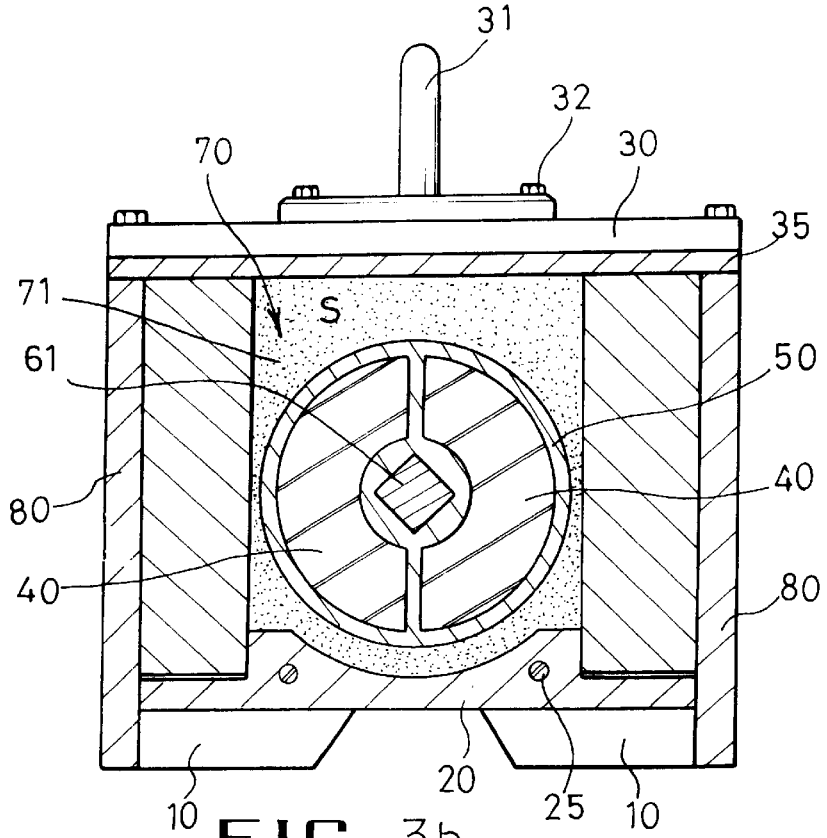
FIGS. 3A and 3B are cross-sectional views of FIG. 2, showing oxidation prevention means 70 filled in the vicinity of rotor 50.
Figure 3B:
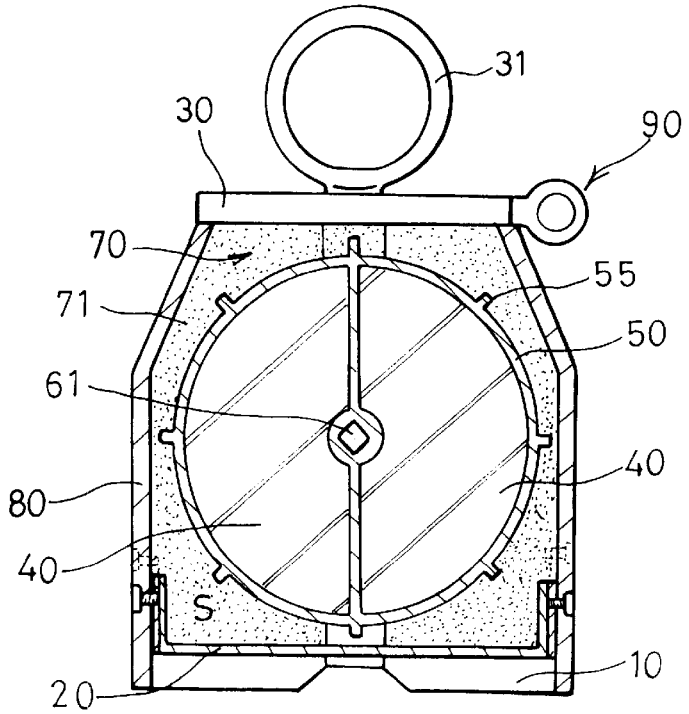

FIGS. 3A and 3B are lateral-cross-sectional views of FIG. 2. The hollow space S in the vicinity of the rotor 50 is filled with the oxidation prevention means 70, specifically the colloidal liquid 71, to block the neodymium magnet 40 in contact with oxygen in atmosphere.

In FIG. 3B, a plurality of protrusions 55 is formed on the rotor 50 with a predetermined interval. Bolts in opposite engage the interval members 20.

Figure 6:
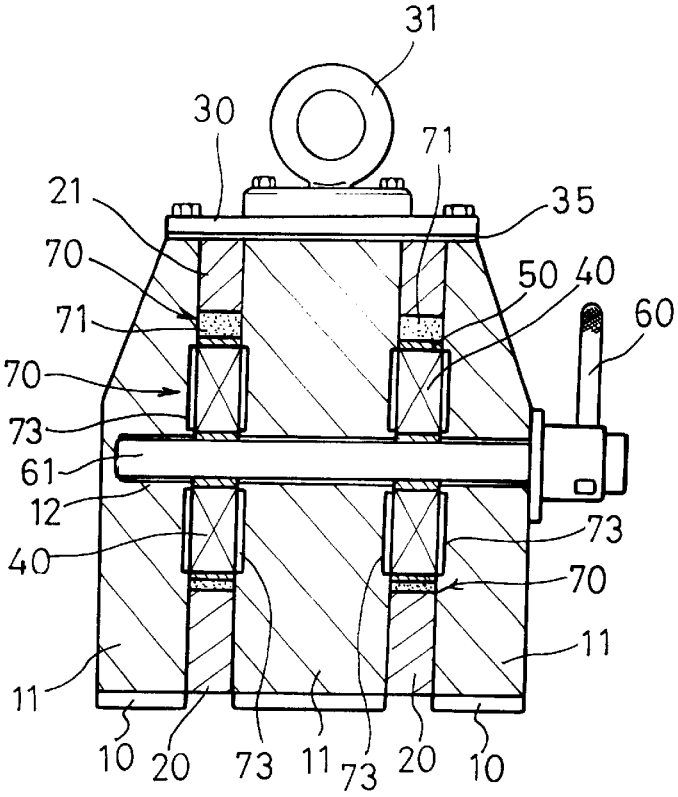
FIG. 6 is a sectional view of FIG. 5.

Referring to FIGS. 5 and 6, the hollow space S formed between the polarity plates 10 and the interval members 20 is filled with the colloidal liquid 71 serving oxidation prevention means 70. It is desirable to form a groove 73 at the non-magnetic medium 11 where the neodymium magnet 40 is rotated by filling the colloidal liquid 71 serving as the oxidation prevention means 70, so that rotation of the neodymium magnet 40 with the rotor 50 is made to keep constant contact with the colloidal liquid 71 on surface of the neodymium magnet 40.

Although the neodymium magnet 40 is repeatedly rotated by means of the switch handle 60, the surface of the neodymium magnet 40 is at all times in contact with the colloidal liquid 71, thereby improving performance and endurance of the neodymium magnet 40.

Figure 7:
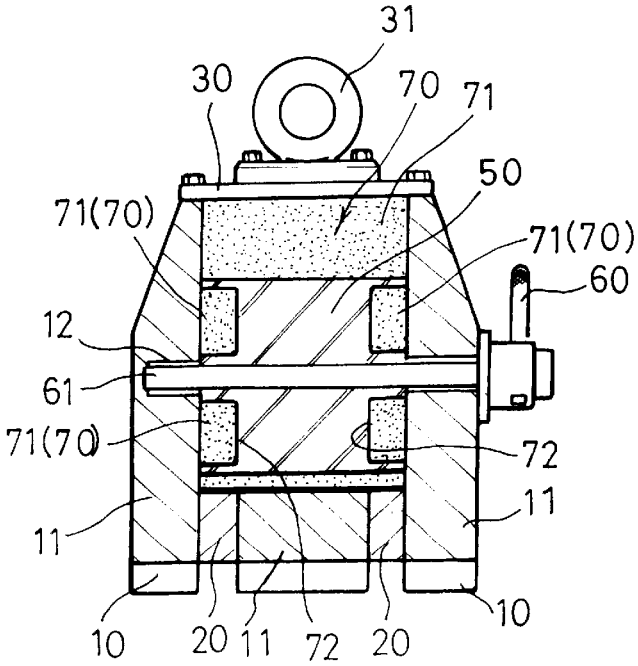
FIG. 7 is a sectional view of another embodiment of the rotor showing a couple of neodymium magnets 40 with respect to the rotor 50 and a couple of polarity plates 10 in opposite.

FIG. 7 is a cross-sectional view of another embodiment of the magnetic lifting apparatus of the invention wherein the boundary of the rotor 50 and the liquid reception apertures 72 in opposite thereof are filled with the oxidation prevention material such as colloidal liquid. In this embodiment, the surface of neodymium magnets 40 in the rotor 50 is made in constant contact with the surface area of the polarity plates 10 in rotation of the rotor 50.

Figure 8A:
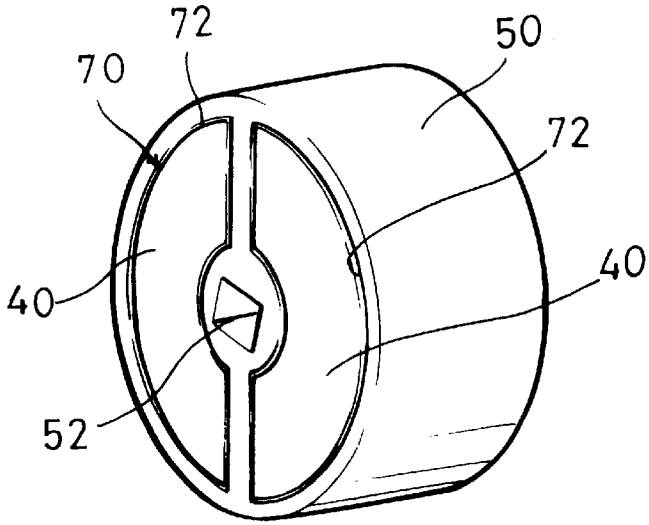
FIGS. 8A, 8B and 8C are perspective views showing modifications of the liquid reception apertures 72 formed in boundary of the neodymium magnet 40 in the rotor 50, for serving as oxidation prevention means 70.
Figure 8B:
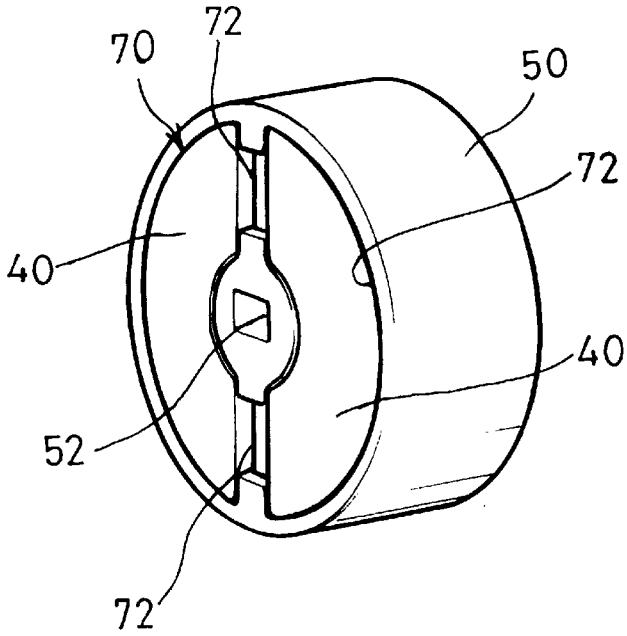
Figure 8C:
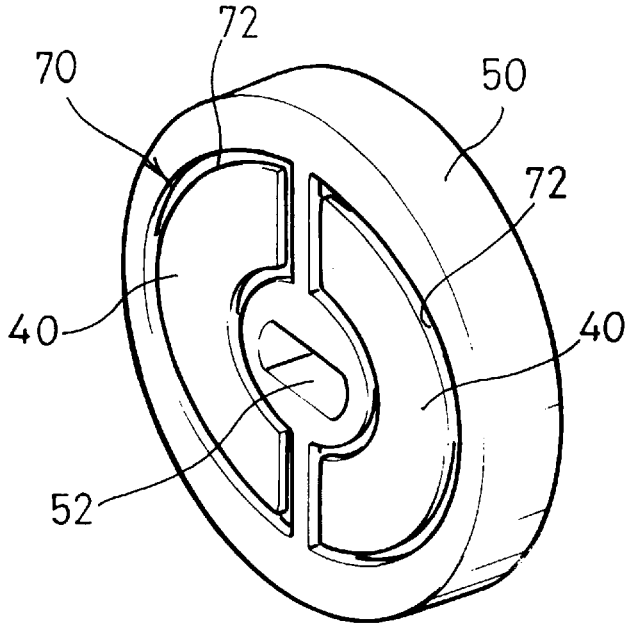

FIGS. 8A, 8B and 8C are perspective views showing modifications of the liquid reception apertures 72 formed in boundary of the neodymium magnet 40 in the rotor 50, for serving as oxidation prevention means 70.

The liquid reception apertures 72 in boundary of the neodymium magnets 40 are filled with the colloidal liquid 71 as the oxidation prevention means 70 in order to prevent the neodymium magnet 40 in contact with oxygen in atmosphere, thereby avoiding oxidation. Specifically, during rotation of the rotor 50 and neodymium magnet 40 held therein colloidal liquid 71 filled in the liquid reception apertures 72 is constantly supplied to the apertures between the neodymium magnet 40 and the polarity plate 10 to have superior oxidation prevention effect.

The liquid reception apertures 72 may be formed in boundary of the neodymium magnet 40 held in the rotor 50 regardless of the hollow space S formed between the polarity plate 10 and the interval member 20 or may be formed with the hollow space S, respectively, to improve oxidation prevention effect.

Figure 9:
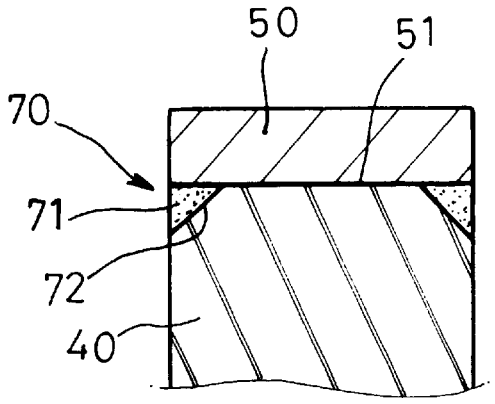
FIG. 9 is a partially enlarged view taken from boundary of the neodymium magnet 40 showing the liquid reception apertures 72 as oxidation prevention means 70.
Figure 10:
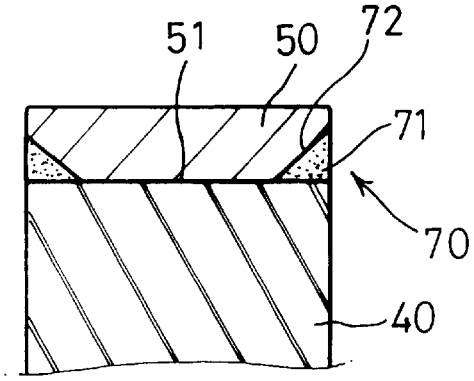
FIG. 10 is a partially enlarged view taken from boundary of the rotor 50 showing the liquid reception apertures 72 as oxidation prevention means 70.

FIGS. 9 and 10 are partially enlarged views of the liquid reception apertures 72 taken from boundary of the neodymium magnet 40 held in the rotor 50; FIG. 9 shows the liquid reception apertures 72 dug along the neodymium magnet 40 and FIG. 10 shows the liquid reception apertures 72 dug along the rotor 50. In any cases, the colloidal liquid 71 fills the liquid reception apertures 72 to have oxidation prevention effect of the oxidation prevention means 70.

FIGS. 11 and 12 show another embodiment of the rotor 50 and the neodymium magnet 40 without hook on the top cover in which the neodymium magnet 40 with two divided forms a rotor 50 in a rod. The rotor 50 suitable for a chuck that is used for fixing the objects on the table is exemplified in the drawings. The rotor 50 is rotatably assembled in a rod shape between the polarity plates 10 in opposite to form a hollow spaces between the polarity plates 10 and interval members 20.

Between the neodymium magnets 40 and the polarity plates 10, the liquid reception clearance 74 is formed to accommodate rotation of the rotor 50 by the colloidal liquid in the hollow space S and coating on the surface of the neodymium magnet 40.

The cap 21 is disposed on the upper space between the polarity plates 10 by means of bolts to surround the rotor 50. The pouring hole 22 is formed at the cap 21 and at the pouring hole 22 a ball 24 elastically supported by a spring 23 is disposed to close up an opening. In case that the oxygen blocking material such as colloidal liquid is poured with higher pressure than the elastic spring 23, the oxygen blocking material is filled around the rotor 50 and the neodymium magnet 40. This fill-up is preferable to do often on demand.

Because the magnetic flux density of the neodymium magnet 40 is greater than the ferrite magnetic to have high magnetic attraction and repulsion, rotation of the switch handle 60 should be locked. ON state of the switch handle 60 causes repulsion and OFF state of the switch handle 60 causes attraction. The switch handle 60 may be unintentionally rotated and the handle-locking member 90 is provided in this case.

It is preferable that the oxidation prevention means 70 may be formed to vacuum the hollow space S to prevent the neodymium magnet 40 from being exposed in oxygen.

It is further preferable that the hollow space S may be filled with the colloidal liquid 71 such as grease, serving as the oxidation prevention material.

In case that the colloidal liquid 71 is filled in the liquid reception apertures 72 dug along the neodymium magnet 40 held in the rotor 50, it improves the oxidation prevention effect.

As explained above, the present invention has an effect to prevent the neodymium magnet from being oxidized to improve magnetic performance and endurance.

Further, the improved magnetic lifting apparatus of the invention minimizes a body size and its weight, guarantees simple operation and improves performance and productivity.

What is claimed is:

1. A magnetic lifting apparatus by using neodymium magnets, comprising:

a plurality of polarity plates disposed with a predetermined interval and having non-magnetic medium in the longitudinal center;

a plurality of interval members disposed between the polarity plates;

a top cover covering the interval members and the polarity plates;

at least one pair of neodymium magnets having S/N polarity in opposite and disposed between the polarity plates;

at least one rotor rotatably mounted with the neodymium magnets inserted therein;

a switch handle for switching polarity position of the rotor and the neodymium magnets engaged therewith to switchably generate magnetic attraction; and oxidation prevention means disposed around the neodymium magnets, for preventing the neodymium magnets from being in contact with oxygen, wherein said oxidation prevention means includes a vacuum hollow space around the neodymium magnet.

2. The magnetic lifting apparatus by using neodymium magnets of claim 1, wherein the rotor includes a magnet reception aperture to locate the neodymium magnets in opposite, and an axial aperture is formed at the center of the rotor to receive a shaft to which end a switch handle is connected to penetrate an axial aperture of the polarity plate for engagement.

3. The magnetic lifting apparatus by using neodymium magnets of claim 1, wherein the rotor is rod-shaped and disposed between the polarity plates for rotation to form a second hollow space between the polarity plates and the interval members and to form a reception clearance between the neodymium magnets and the polarity plates.

4. The magnetic lifting apparatus by using neodymium magnets of claim 1, wherein a cap is disposed on the open upper part of the interval members to surround the rotor via bolts.

5. The magnetic lifting apparatus by using neodymium magnets of claim 4, wherein a pouring hole at the cap is formed as such that a ball elastically supported by a spring is installed to close up the opening from the bottom of the pouring hole by pouring the oxygen blocking material with higher pressure than the elastic spring to fill around the rotor and the neodymium magnets.

6. A magnetic lifting apparatus by using neodymium magnets, comprising:

a plurality of polarity plates disposed with a predetermined interval and having non-magnetic medium in the longitudinal center;

a plurality of interval members disposed between the polarity plates;

a top cover covering the interval members and the polarity plates;

at least one pair of neodymium magnets having S/N polarity in opposite and disposed between the polarity plates;

at least one rotor rotatably mounted with the neodymium magnets inserted therein;

a switch handle for switching polarity position of the rotor and the neodymium magnets engaged therewith to switchably generate magnetic attraction; and oxidation prevention means disposed around the neodymium magnets, for preventing the neodymium magnets from being in contact with oxygen, wherein said oxidation prevention means includes a hollow space around the rotor and filled with an oxidation prevention material in a liquid state.

7. A magnetic lifting apparatus by using neodymium magnets of claim 6, wherein said oxidation prevention means further includes at least one liquid reception aperture formed in boundary of the neodymium magnets in the rotor and filled with the oxidation prevention material in a liquid state.

8. A magnetic lifting apparatus by using neodymium magnets of claim 6, wherein said oxidation prevention means further includes a groove at the non-magnetic medium disposed in the position of rotation of the neodymium magnets and filled with the oxidation prevention material in a liquid state.

9. The magnetic lifting apparatus by using neodymium magnets of claim 6, wherein said oxidation prevention material in a liquid state includes at least one of grease, lubricating oil and colloidal liquid.

10. The magnetic lifting apparatus by using neodymium magnets of claim 6, wherein a cap is disposed on the open upper part of the interval members to surround the rotor via bolts.

11. The magnetic lifting apparatus by using neodymium magnets of claim 6, wherein the rotor includes a magnet reception aperture to locate the neodymium magnets in opposite, and an axial aperture is formed at the center of the rotor to receive a shaft to which end a switch handle is connected to penetrate an axial aperture of the polarity plate for engagement.

12. The magnetic lifting apparatus by using neodymium magnets of claim 6, wherein the rotor is rod-shaped and disposed between the polarity plates for rotation to form a second hollow space between the polarity plates and the interval members and to form a reception clearance between the neodymium magnets and the polarity plates.

* * * * *